US005230236A

United States Patent [19]

Nakamura et al.

[11] Patent Number: 5,230,236

[45] Date of Patent: Jul. 27, 1993

[54] ROLLING MILL DRIVING MECHANISM

[75] Inventors: Mitsuru Nakamura; Yutaka Toda, both of Muroran; Yukio Noguchi; Toshihiro Ishibashi, both of Futtsu; Ichizo Taguchi; Jun-ichi Tsumura, both of Sakai, all of Japan

[73] Assignees: Nippon Steel Corporation; Hitachi Zosen Corporation, both of Japan

[21] Appl. No.: 771,456

[22] Filed: Oct. 1, 1991

[30] Foreign Application Priority Data

Oct. 3, 1990 [JP] Japan ..... 2-267099
Oct. 11, 1990 [JP] Japan ..... 2-106621
Mar. 15, 1991 [JP] Japan ..... 3-51560

[51] Int. Cl.[5] ..... B21B 35/02
[52] U.S. Cl. ..... 72/249; 72/205
[58] Field of Search ..... 72/205, 234, 249; 74/665 GA

[56] References Cited

U.S. PATENT DOCUMENTS 3,595,055 7/1971 Rohde ..... 72/226
3,992,915 11/1976 Hermes et al. ..... 72/249
4,408,474 10/1983 Hutzenlaub et al. ..... 72/205
4,577,529 3/1986 Romi ..... 74/665 GA
4,907,438 3/1990 Sasaki et al. ..... 72/235
4,966,027 10/1990 Danielsson ..... 72/235
5,086,399 2/1992 Tsugeno et al. ..... 72/8

FOREIGN PATENT DOCUMENTS 0208803 1/1987 European Pat. Off. ..... 72/249
62-230413 10/1987 Japan .
0043702 2/1988 Japan .

*Primary Examiner*—Lowell A. Larson
*Assistant Examiner*—Thomas C. Schoeffler
*Attorney, Agent, or Firm*—Barnes, Kisselle, Raisch, Choate, Whittemore & Hulbert

[57] ABSTRACT

The invention is directed to provide a rolling method which enables an enlarged range of reduction ratio in sizing-rolling in the common drive system. The invention provides that when tension applied to rolled material between the upstream and downstream-placed mills is made higher than a value that tension/average resistance to deformation of rolled material is 0.2, the upstream-placed mill is caused to perform force rolling, and when compressive force of the rolled material is made higher than a value that compressive force/average resistance to deformation of rolled material is 0.1, the downstream-placed mill together with the upstream-placed mill are caused to perform tensile rolling in the common drive system. The rolling methods provides a stable rolling in a larger sizing range without decrease of diameter or buckling of rolled material.

2 Claims, 6 Drawing Sheets

ROLLING MILL DRIVING MECHANISM

FIELD OF THE INVENTION

The invention relates to a sizing-rolling method for continuous length sections by a rolling mill driven in common drive system, and a rolling mill driving mechanism, a roll depressing mechanism and a roll fixing mechanism for use in carrying out the sizing-rolling method.

BACKGROUND OF THE INVENTION

There generally are two systems for applying driving force to a plurality of rolling mills arranged along a rolling line for rolling continuous length sections such as bar, wire rod or the like such that the rolling mills may be provided with respective motors to be driven separately, or that a plurality of rolling mills are interlocked through a driving mechanism to be given a driving force by a single motor (this is herein called the "common drive system"). In the former system providing the respective motors for each rolling mill, the rotating speed of the motors are set separately in consideration of variance of tension applied to the rolled material between the rolling mills corresponding to variance of area reduction ratio of the material being delivered from each of the stands in question. By contrast, the common drive system of the prior art lacks versatility in that, once a specific gear ratio is set in a gear transmission assembly, the relative roll speed of the two stands cannot be varied unless the gear ratio is changed.

Finish rolling of continuous length sections in a heated rolling line may be conducted in such manner that roll calibers are exchanged corresponding to variance of specific sizes of rolled products, or that a single roll caliber is used to depress the rolls into desired positions for providing rolled products with separate sizes (the technique is herein called "sizing-rolling").

The trouble is that, every time the parting of the mill rolls is adjusted at one or more roll stands in a rolling mill having a plurality of serially connected roll stands driven by a common drive, the material undergoes a sharp increase or decease in the tension between the stands. Consequently, product quality is adversely affected by an undesirable decrease in the diameters of products and breakage of rolled material by tension, increment of products diameters by compressive force and buckling of rolled material. Hence, an extent of sizing with adjustment of depressed positions of rolls is limited.

As one of the conventional measures to prevent the foregoing from occurring in a rolling mill having a plurality of serially connected three-roll stands driven by a common drive, it has been proposed (e.g. by a brochure published by Kock, Germany) to use a rolling-mill technique characterized in that all stands are driven until the moment when the material is caught in a roll stand disposed at the upstream end, and that all but said roll stand are disengaged from said common drive by means of one-way clutches at the above-mentioned moment so as to allow the material to be thrusted into the idling roll stands, provided that the area reduction to be finally attained at a roll stand disposed at the downstream end is small.

This rolling technique does not provide a stable rolling in sizing-rolling operation at a higher area reduction ratio, for example, of 20% by use of two 3-roll rolling mills as disclosed in Japanese Unexamined Patent Publication No. 43702/1988 since tension applied to rolled material between rolling mills varies largely corresponding to the specific sizing amounts and the rolled material is subjected to a higher compressive force due to force rolling. For carrying out a stable sizing-rolling, it is required to reduce a sizing range, lessen intervals between the rolling mills for eliminating influences on rolled material with compressive force applied thereto and enlarge diameters of rolled products.

Let it be supposed that two roll stands are connected to a common drive through a gear transmission assembly, that a gear ratio set in the gear transmission assembly is such that the material undergoes no tension between the stands when they are operated with an area reduction of 20% to be finally attained at the roll stand disposed at the downstream side, and that the actual parting of the mill rolls is such that an area reduction which can be finally attained at the roll stand disposed at the downstream side is much smaller than 20%. When the two roll stands are operated under this condition, the material undergoes unusually high tension between the rolling mills, thereby decreasing the diameter of the rolled material and possibly breaking the same.

Also, when two rolling mills are connected with each other through their respective drive systems and a one-way clutch is disposed at the drive system of one rolling mill placed downstream, so that when rolled material is just caught in the roll stand disposed at the downstream side, this roll stand is disengaged from the drive by means of the one-way clutch. Then the roll stand disposed at the upstream side will have the effect of thrusting the material into the idling roll stand disposed at the downstream side. The result is that, when the parting of the mill rolls is set in such a manner that a large area reduction is finally attained at the roll stand disposed at the downstream side, the material between the stands will undergo unusually high compressive stress and will be buckled or subjected to wave motion.

Accordingly, the known 3-roll rolling method has a problem that it is not capable of rolling the material of a larger area reduction ratio, i.e., in a wider sizing range.

SUMMARY OF THE INVENTION

The present invention has been designed to overcome the above problem. An object of the present invention is to provide a sizing-rolling method for continuous length sections and a rolling mill driving mechanism for conducting the sizing-rolling method in a wider sizing range with a stable rolling operation wholly therethrough.

This object is achieved with a sizing mill operated under a common driving system, comprising prime mover means adapted to drive two rolling mills each placed upstream and downstream respectively in the rolling direction by use of a single motor in a heated rolling process for continuous length sections so as to conduct sizing-rolling, wherein when tension applied to rolled material between the two rolling mills is made higher than a value that tension/average resistance to deformation of rolled material is 0.2, a drive system for one rolling mill placed downstream is disconnected to allow the other rolling mill placed upstream to perform force rolling, and when compressive force applied to rolled material between the two rolling mills is made higher than a value that compressive force/average resistance to deformation of rolled material is 0.1, the drive system for the rolling mill placed downstream is connected to allow this rolling mill together with that placed upstream to perform tensile rolling in the common drive system.

Also, a driving mechanism for the rolling mill of the present invention is provided for carrying out the above rolling method and comprises: a first transmission means enabling force rolling wherein a driving force from a universal joint is transmitted to a lower input gear and a lower intermediate gear lower in speed ratio than an upper input gear and an upper intermediate gear through a one-way clutch disconnecting communication of the upper input gear with the lower input gear and the remainder due to high speed of rolled material and then further transmitted to a drive gear for turning a roll drive shaft; and a second transmission means enabling tensile rolling wherein a driving force from the universal joint is transmitted from the upper input gear and upper intermediate gear to the lower intermediate gear through a connecting clutch, and then to the drive gear for turning the roll drive shaft, the first and second transmission means being integrally combined and being capable of being selectively switched for operation.

In operation of sizing-rolling by driving a plurality of rolling mills by a single motor, when in a smaller sizing range (at a lower area reduction ratio), force rolling by one rolling mill applied with a driving force is to be performed, and when at an area reduction ratio that compressive force is made higher than a value that compressive force/average resistance to deformation of rolled material is 0.1, the driving system is changed through the gear transmission to the common drive system for driving both of the rolling mills. In this instance, the gear ratio for connecting the driving mechanism for the common drive system is to be selected to set tension applied to rolled material between the rolling mills to any as not made higher than a value that tension/average resistance to deformation of rolled material is 0.2 at that area reduction ratio.

In case that the compressive force applied to rolled material between rolling mills is made higher than a value that compressive force/average resistance to deformation of rolled material is 0.1, the rolled material is made excessively larger in width due to rolling through the compressive force between the mills, resulting in that a desired size of products cannot be achieved while there is a fear that vibration of rolled material and further buckling thereof are created by the compressive force. Also, in the range where tension applied to rolled material is made higher than a value that tension/average resistance to deformation of rolled material is 0.2, diameters of rolled material is decreased by the tension and a predetermined size of products cannot be achieved while vibration of rolling mill rolls occurs due to the tension. Hence, the driving system for the rolling mills are to be switched corresponding to the specific compressive force and tension applied to rolled material between the rolling mills.

The roll depressing device for rolling mills of the present invention comprises three rolling rolls arranged radially at an interval of 120°, roll holders for holding the rolls, support frames for rotatably supporting the roll holders around an eccentric point and provided circumferentially with serrations for worm wheels, worm shafts engaging with the support frames and provided at an end with a gear, depressing system/rotative driving mechanisms for rotating the worm shafts through that gear, a sensor for detecting rotational positions of the support frames, so that the depressing system/rotative driving mechanisms are controlled according to detected signals of the sensor.

The roll depressing device is so constructed that the depressing system/rotative driving mechanisms are provided for separately turning the support frames which adjust the depressing amount of each rolling rolls. Hence, there is no need to consider sizes of interlocking bevel gears which may be provided as conventionally, for example, at the ends of the support frames for allowing a single depressing system/rotative driving mechanism to adjust the depressing amount of every support frames. As a result, drive transmission torque required for depressing the rolls can be made larger. Also, the rotative driving mechanisms for depressing the rolling rolls may be provided separately to allow the depressing amount of the rolls to be adjusted separately and freely.

The roll fixing device for the rolling mill of the present invention is provided for fixing the rolling rolls in such manner that the rolling roll is sandwiched at both lateral sides by a pair of roll holders which are approached to each other by a tightening member so as to fix the rolling roll with a serrated part being interposed at the contacting surfaces between the rolling roll and the roll holders.

According to the roll fixing device, fixing of the rolling roll and the roll holders is carried out through the serrated part, so that they can be surely and simply fixed merely by tightening the tightening member to cause the pair of roll holders to approach to each other. For simple and quick replacement of rolling rolls, they may be removed simply by loosening the tightening member to separate the roll holders and disconnect the serrated part.

DETAILED DESCRIPTION OF THE PREFERRED EMBODIMENTS

Figure 1:
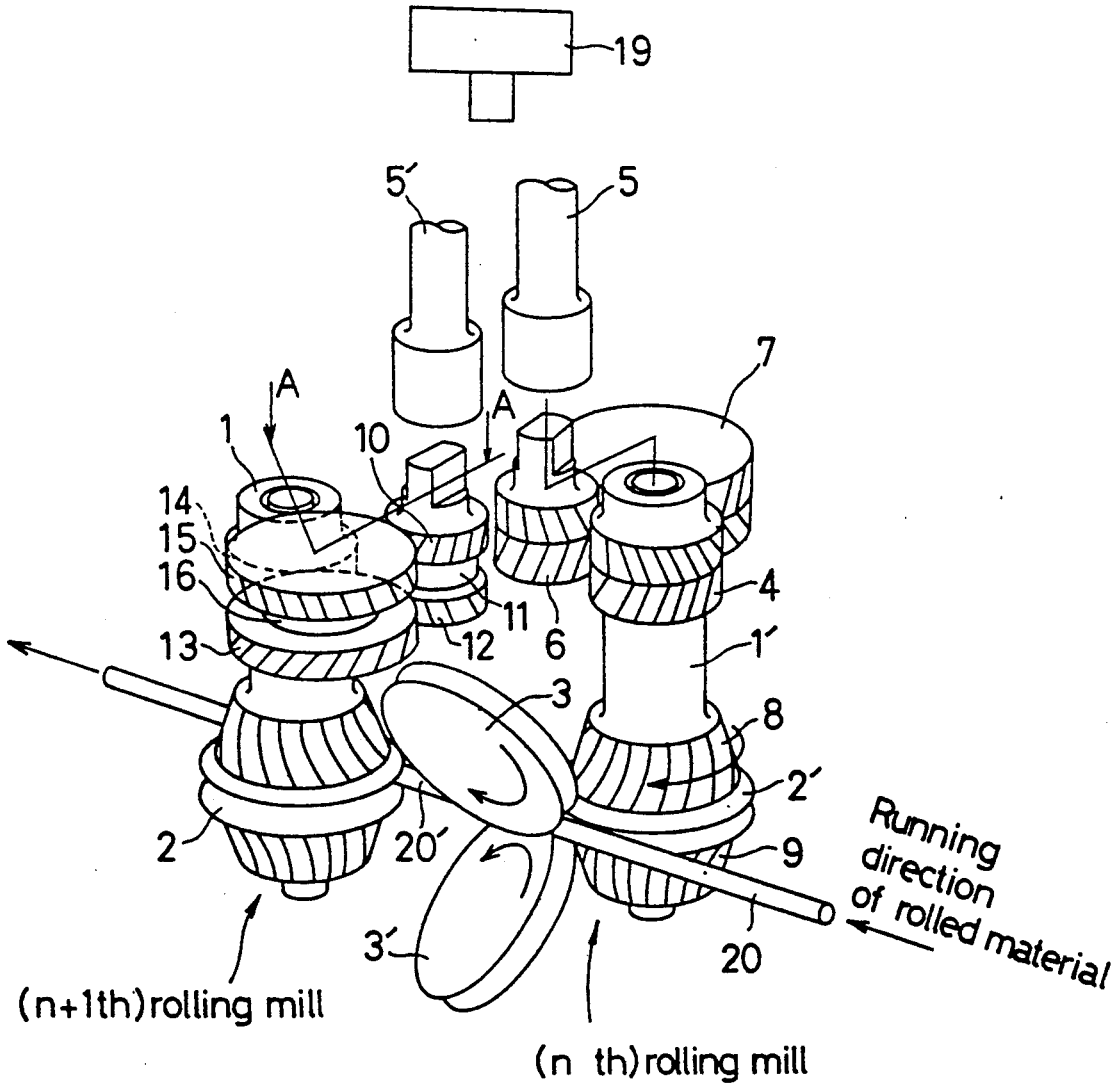
FIG. 1 is a schematic perspective view of the driving mechanism used in the example.

In referring first to FIG. 1 of the drawings, it will be noted that a sizing mill operated under a common driving system in accordance with the present invention includes an upstream rolling mill and a downstream rolling mill driven by a common prime mover. These two rolling mills may be the nth and (n+1)th ones of a plurality of rolling mills arranged in series.

In FIG. 1 is shown the 3-roll rolling mills in which two rolls 3, 3' (not shown at the mill placed downstream) are arranged at an interval of 120° with respect to rolls 2, 2' fixed on drive shafts 1,1'.

To cause a drive gear 4 connected to the drive shaft 1' of the first (n th) mill placed upstream and an input gear 6 connected to a universal joint 5 to correspond in rotational direction to each other, the gears 4 and 6 are provided with an intermediate gear 7. In this case, a driving force from a motor 19 is transmitted to the rolls through the universal joint 5—input gear 6—intermediate gear 7—drive gear 4—drive shaft 1'—bevel gears 8 and 9.

The second (n+1 th) mill placed downstream is so disposed that it has arrangement of rolls symmetrized to that of the mill placed upstream with respect to an axis of the rolling line, and is positioned downstream in the running direction of rolled material 20 with respect to the upstream placed mill. The downstream-placed mill is provided with two systems of drive transmission routes.

Figure 2:
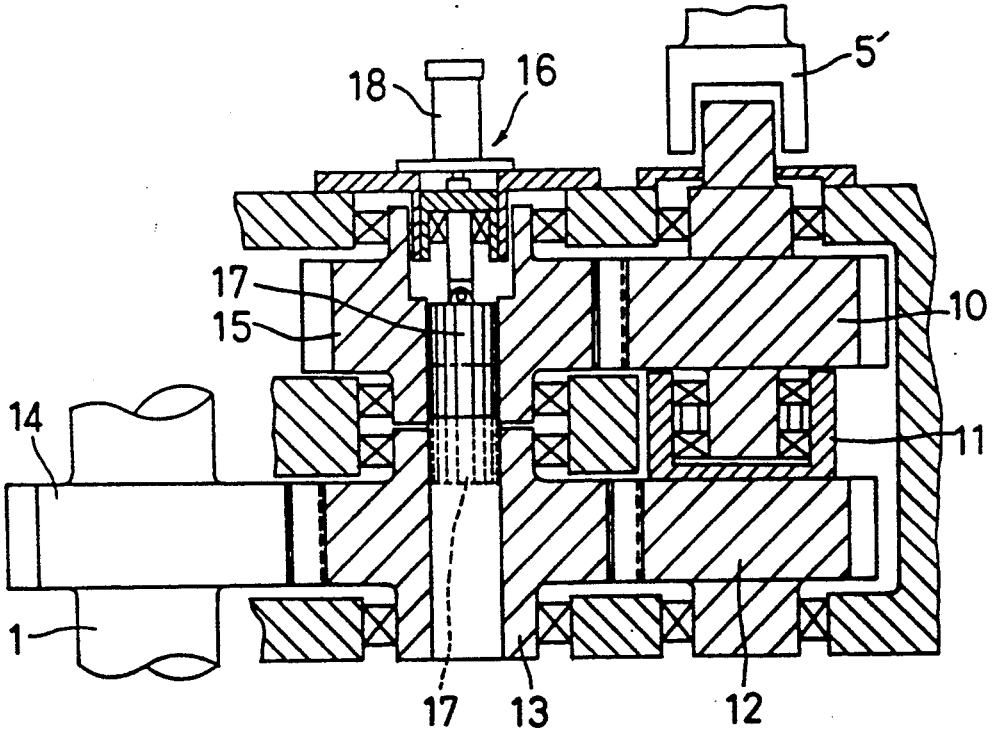
FIG. 2 is a sectional view taken from the line A-A in FIG. 3.

One of the drive transmission routes is a first transmission mechanism wherein a driving force is transmitted as upper input gear 10—oneway clutch 11—lower input gear 12—lower intermediate gear 13—drive gear 14 when a connecting clutch 16 disposed between the upper intermediate gear 15 and lower intermediate gear 13 is disconnected (in the state shown in FIG. 2 where the clutch rod 17 is in position indicated by solid line).

In operation of the above transmission mechanism, a rotational speed of the rolls of the downstream-placed mill is lower than the running speed of rolled material 20' at the upstream-placed mill, so that when the rolled material is caught by the downstream-placed mill, the one-way clutch 11 is activated to stop transmission of driving force from the motor, thereby causing the upstream-placed mill to perform force rolling.

The other transmission route is a second transmission mechanism wherein a clutch rod 17 of a connecting clutch 16 mounted between an upper intermediate gear 15 and lower intermediate gear 13 is connected as shown by dotted line in FIG. 2 to transmit a driving force between the gears 15 and 13. In operation of the second transmission mechanism, a rotational speed ratio of the upper input gear 10 and upper intermediate gear 15 is larger than that of the lower input gear 12 and lower intermediate gear 13, so that the lower input gear 12 is rotated at higher speed than the upper input gear 10 to activate the oneway clutch 11, thereby stopping drive transmission between the upper input gear 10 and lower input gear 12. Hence, a driving force from the motor is transmitted from the universal joint 5' to upper input gear 10—upper intermediate gear 15—connecting clutch 16—lower intermediate gear 13—drive gear 14. Since the driving force form the motor is transmitted to the rolls in this transmission route, tensile rolling in the common drive system is enabled.

Next, a specific mechanism for drive transmission at the rolling mills will be referred to with FIG. 2.

FIG. 2 is a sectional view taken from the line A—A in FIG. 1 and shows a principal portion of the transmission mechanism, i.e., input gears 10, 12, intermediate gears 13 and 15 and drive gear. Difference in drive transmission system between force rolling and tensile rolling in the common drive will be detailed.

When conducting force rolling, the connecting clutch rod 17 is pulled up to the position shown by the solid line by use of a hydraulic cylinder 18 and there is no transmission of driving force between the upper and lower intermediate gears 15 and 13. Driving force from the motor 19 is transmitted from the upper input gear 10, through the oneway clutch 11 to the lower input gear 12, lower intermediate gear 13 and drive gear 14. In this case, rotational speed ratio of the input gears 10, 12, intermediate gears 13, 15 and drive gear 14 is set to be lower than that in the upstream-placed mill, so that the rolls when not rolling the material are rotated by the drive force from the motor. When the material rolled at the upstream-placed mill is caught by the downstream-placed mill, the roll 2, drive shaft 1, drive gear 14, lower intermediate gear 13 and lower input gear 12 of the downstream-placed mill are rotated by the rolled material since the material's running speed is higher than the rotational speed of the roll. The oneway clutch 11 which is mounted in a direction to transmit driving force in the state of no rolling of material is activated through rotation of the lower input gear 12 at higher speed than upper input gear 10 due to force rolling by the upstream-placed mill, so that a driving force from the motor is not transmitted to the roll of the downstream-placed mill, thereby allowing force rolling from the upstream-placed mill to the downstream-place mill.

For conducting tensile rolling in the common drive system, the connecting clutch rod 17 is moved down to the position shown by dotted line by use of the hydraulic cylinder 18. The sliding portions of the connecting clutch rod 17, upper and lower intermediate gears 15 and 13 are sprined, so that the gears 15 and 13 are connected through the clutch rod 17 to allow driving force to be transmitted between the gears 15 and 13. Gear ratios of the upper input and intermediate gears 10, 15, lower intermediate gear 13 and drive gear 14 of the downstream-placed mill are so set that when the downstream-placed mill has a maximum area reduction ratio, there is no tension applied to rolled material between the upstream and downstream placed mills, thereby enabling rolling therebetween in the common drive system. Rotational speed ratio of the upper input and intermediate gears 10 and 15 is set higher than that of lower input and intermediate gears 12, 13 for enabling both of the common drive rolling and force rolling, so that the lower input gear 12 is rotated faster than the upper input gear 10 to activate the oneway clutch 11 and stop transmission of drive force by the lower and upper input gears 12 and 10, resulting in that a drive force from the motor is transmitted as upper input gear 10—upper intermediate gear 15—connecting clutch rod 17—lower intermediate gear 13—drive gear 14.

The operation of the aforesaid sizing mill is as follows:

In the range that the downstream-placed mill has a smaller sizing amount (at a smaller area reduction ratio), in turn, compressive force generated by force rolling through the oneway clutch and applied to material between the mills is not made higher than a value that compressive force/average resistance to deformation of rolled material is 0.1, the two rolling mills are interconnected through their driving systems before rolled material is caught by the downstream-placed mill, so that the mills are driven by a single motor. After the rolled material is caught by the downstream-placed mill, the oneway clutch 11 is operated to stop transmission of driving force to the downstream-placed mill, thereby allowing the upstream-placed mill to conduct force rolling to the downstream-placed mill. As increasing the amount of sizing at the downstream-placed mill, compressive force exerted on the rolled material between the upstream and downstream-placed mills increases and to a value that compressive force/average resistance to deformation of rolled material is 0.1. When compressive force increases to be higher than a value that compressive force/average resistance to deformation of rolled material is 0.1, driving of the two 3-roll mills are changed to the common drive system wherein both of the mills are driven at a predetermined gear ratio that is selected to be lower than a value that tension/average resistance to deformation of rolled material is 0.2 at a specific area reduction ratio for switching from the foregoing operation by the oneway clutch. Also, in the range of a larger sizing amount (at a larger area reduction ratio), both the mills are interlocked to be driven for performing rolling. As seen, the drive system for the plurality of rolling mills to be driven by a single motor is changed in the specific sizing ranges, thereby enabling a stable rolling operation wholy in a larger extent of sizing ranges.

The present invention may be applicable to sizing-rolling in 2-roll rolling mills as well as in the aforesaid 3-roll rolling mills.

Specific sizing-rolling will be explained hereunder.

In heated rolling process of barstock by use of 3-roll rolling mills in the common drive system as shown in FIG. 1 provided rearwardly of the rough rolling mill group, sizing-rolling was applied for two sizes 48.4 mm and 45.6 mm in diameter for the rolled barstock of 50 mm in diameter rolled by the rough rolling mill group. Rolling conditions are that gear ratio of the rolling mills are set to have no tension applied to the material at area reduction ratio of 20%, and rolling systems at specific area reduction ratios for the above two sizes, i.e., force rolling or tensile rolling were selectively decided based on research of a stable rolling range at the same gear ratio. The material is those classified at S45C in JIS and adjusted of temperature in pre-process to have 900° C. between the rolling mills. The average resistance to deformation of the material at 900° C. was confirmed to be 16 kgf/mm2 in our preliminary inspection. Sizing-rolling for the abovesaid two sizes will be detailed hereunder.

(1) Sizing-rolling for 48.4 mm from 50 mm diameter

A general area reduction ratio was 6.3% but was changed to 4.4% at the upstream-placed mill and 1.9% at the downstream-placed mill for the sizing operations. Since force rolling was carried out at the point that the area reduction ratio is 6.3%, force rolling was adopted. Sizing-rolling was carried out through the first transmission mechanism at the downstream-placed mill wherein the connecting clutch 16 is disconnected (in the state where the clutch rod 17 is placed in position shown by solid line in FIG. 2), a driving force from the motor 19 is transmitted as input gear 10—oneway clutch 11—lower input gear 12—lower intermediate gear 13—drive gear 14, so that the roll 2 is driven through the drive shaft 1. In this case, rotation of the roll by the driving force from the motor is made before the material rolled at the upstream-placed mill is caught by the downstream-placed mill. Then, the oneway clutch 11 was operated since the running speed of rolled material 20' is higher than rotational speed of the roll, so that the roll was rotated through the force rolling by the upstream-placed mill, thereby providing a stable rolling without buckling of rolled material.

Compressive force caused by force rolling and measured between the two rolling mills was 1.44 kgf/mm2, so that: (compressive force between the rolling mills)-/(average resistance to deformation of rolled material)=(1.44 kgf/mm2)/(16 kgf/mm2)=0.09 which value is in the range less than 0.1 of the present invention.

(2) Sizing-rolling for 45.6 mm from 50 mm diameter

A general area reduction ratio was 16.8% but was changed to 11.8% at the upstream-placed mill and 5.0% at the downstream-placed mill for the sizing operation. Since tensile rolling in the common drive system was carried out at the point that the area reductin ratio is 16.8%, tensile rolling was adopted. Tensile sizing-rolling in the common drive system was carried out through the second transmission mechanism at the downstream-placed mill with the upstream-placed mill wherein the connecting clutch rod 17 was placed in position shown by the dotted line in FIG. 2 by use of the hydralic cylinder 18 to interlock the upper intermediate gear 15 with the lower intermediate gear 13, a driving force from the motor 19 is transmitted as upper input gear 10—upper intermediate gear 15—lower intermediate gear 13—drive gear 14, so that the roll 2 is driven through the drive shaft 1. As a result, there caused no decrease of diameter of rolled material but obtained bar of a predetermined product size. Tension caused by the tensile rolling and measured between the two rolling mills was 0.8 kgf/mm2, so that: (tension between the rolling mills)/(average resistance to deformation of rolled material)=(0.8 kgf/mm2)/(16 kgf/mm2)=0.05 which value is satisfactorily in the range less than 0.2 of the present invention.

As explained above, the conventional sizing-rolling for continuous length sections in the known common drive system provided sizing only in an extent of a few percent of the entire range of area reduction ratio. By contrary, the sizing-rolling method and the driving mechanism for performing the same of the present example can achieve the stable sizing-rolling in the entire range and provide the products of preferable sizes.

Figure 3:
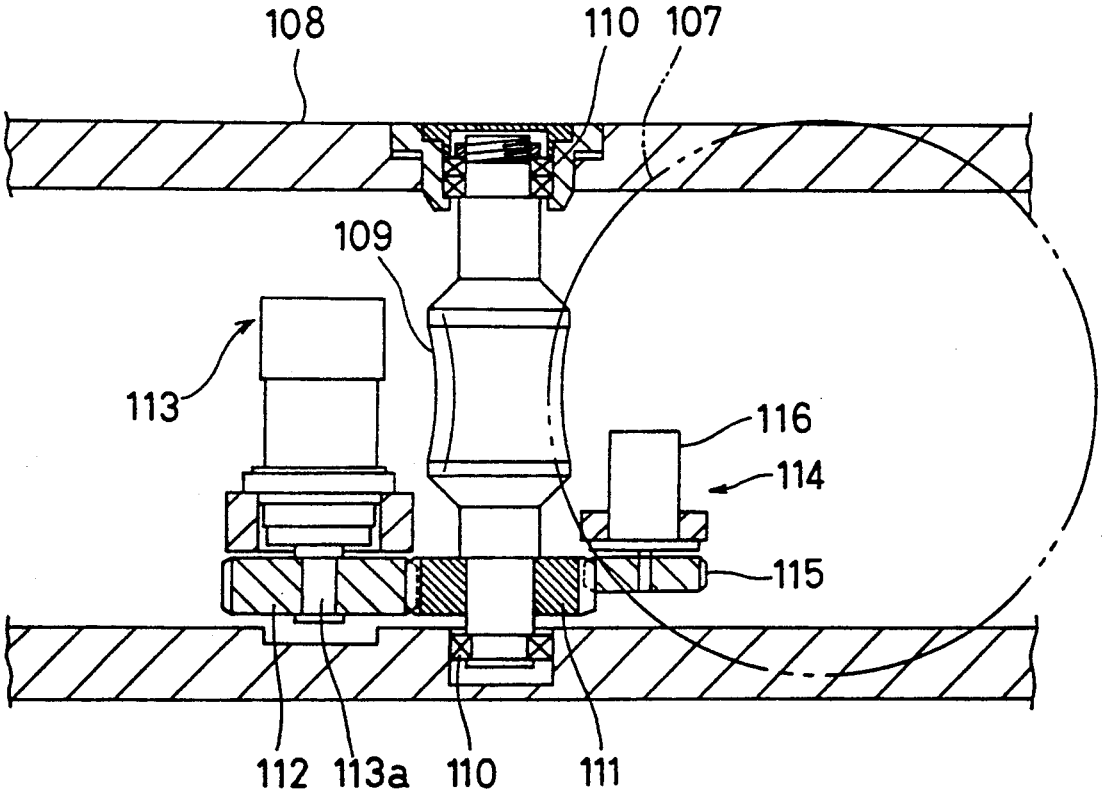
FIG. 3 is a sectional view of a principal portion in a preferred embodiment for a roll depressing device in 3-roll rolling mill.
Figure 4:
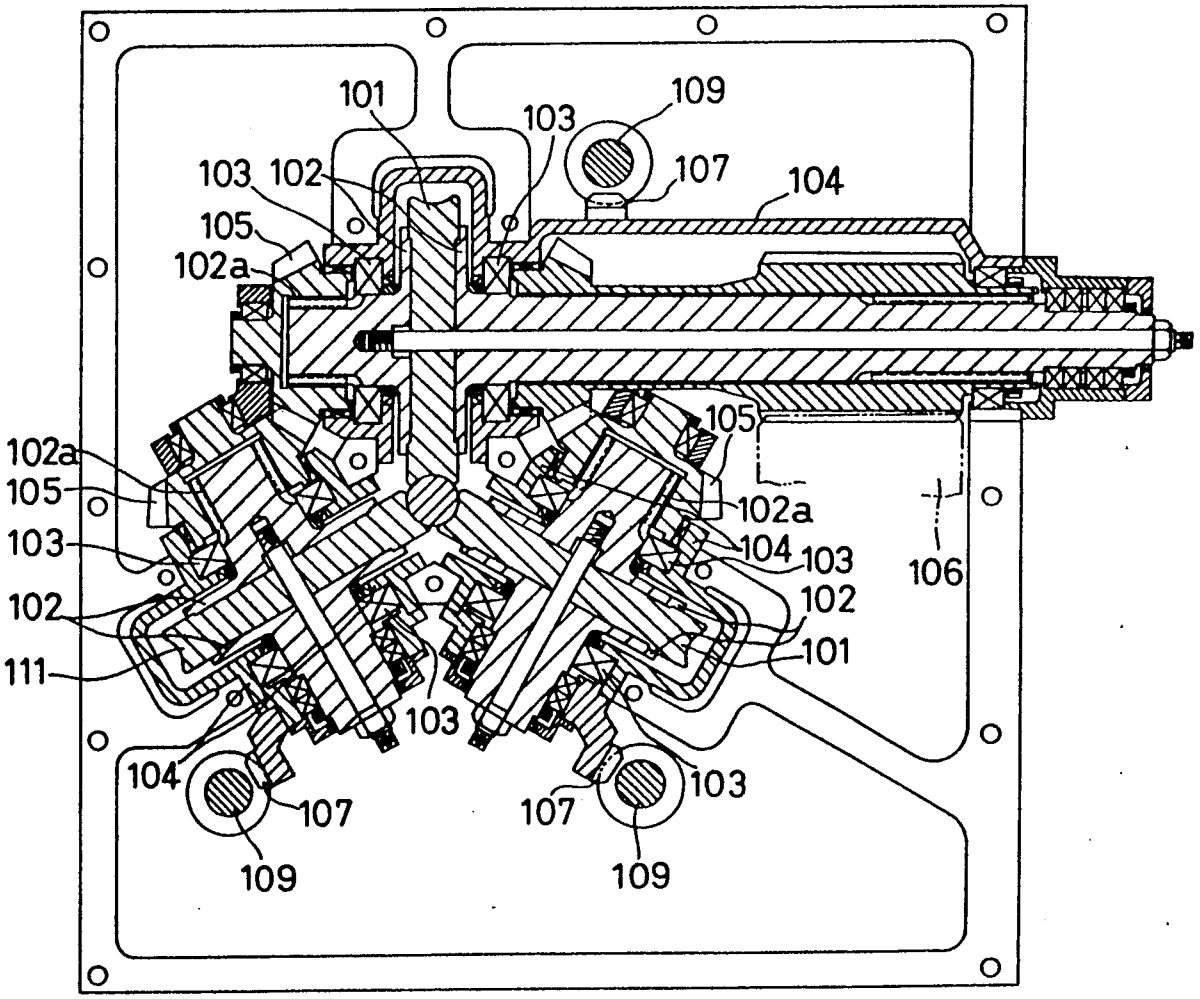
FIG. 4 is an entire sectional view of the roll depressing device.

Next, a preferred embodiment of a depressing device for rolls of the aforesaid 3-roll rolling mills will be referred to with FIGS. 3 and 4.

In FIG. 4, 101 denotes three rolling rolls arranged radially at an interval of 120° in the vertical plane. The rolls 101 are supported by the respective roll holders 102 which are supported through bearings 103 by tubular support frames 104 rotatably at an eccentric point.

The rolling rolls 101 are adapted to be associatively driven for rotation by an input side gear 106 through an internal gear **102*a* and bevel gear 105 formed at the roll holders 102**.

The tubular support frames 104 for adjusting the depression amount of the rolling rolls 101 are separately driven for rotation.

In detail, the tubular support frames 104 are provided with serrated portion 107 for worm wheel (a part of worm wheel). As shown in FIG. 3, at the mill housing are provided through bearings 110 worm shafts 109 engageable with the serrated portions 107 of the worm wheel. A driven gear 111 is mounted at one end of the worm shaft 109 and the mill housing 108 houses therein a hydraulic motor (an example for the depressing system/rotative driving device, any other type of motor may be applicable) mounting on its output shaft **113*a* a driving gear 112 engageable with the driven gear 111**.

At the driven gear 111 is provided a sensor 114 which detects an amount of rotation (or rotational positions) of the worm shaft 109. The sensor 114 comprises a sensor gear 115 engaging with the driven gear 111 and a rotary encoder 116 which is to be rotated by the sensor gear 115.

Signals from the sensors 114 based on detection about the worm shafts 109 are input to a controller (not shown), so that the hydraulic motors 113 are controlled according to the detection signals to cause all of the tubular support frames 104 to have the same amount of rotation, thereby equalizing the depression amount of the rolling rolls 101.

Accordingly, when the hydraulic motors 103 are activated by the controllers, the tubular support frames 104 are rotated at the same amount through the worm shaft 9, thereby causing the rolling rolls 101 to be depressed down at a uniform amount.

Though not shown, there is given consideration to prevent mutual backlashing in engagement of the driven gear 111 and the sensor gear 115 so as to provide a precise amount of depression for the rolling rolls 101. In detail, either of the driven gear 111 or the sensor gear 115 comprise two gears which are mounted as meshing with each other in a reverse direction that meshing points of one pair of such gears may always contact with each other in a clockwise rotation while those of the other pair of the gears may always contact with each other in a counterclockwise rotation.

The driven gear 111 and driving gear 112 may be constructed as having no backlashing as the aforesaid couple of the driven gear 111 and the sensor gear 115.

In the abovesaid example, detection of the depression amount of the rolling rolls 101 is based on the rotational amount of worm shaft 109 but should not be limited thereto and may directly detect a rotational amount of tubular support frames 104.

According to the structure of the roll depressing device of the present rolling mill, there is provided the depressing system/rotative driving device for separately rotating the support frames which adjusts the depression of rolling rolls. Hence, in comparison with a conventional device which provides an interlocking bevel gear at the ends of the support frames to adjust the depression amount of all the support frames by use of a single depressing system/rotative driving device, the invention is not required to consider the sizes of such interlocking gear (since there is not an extra space for arrangement of the support frames, the bevel gear interlocking the support frames is inevitably limited in sizes). Hence, the drive gear can be provided without limitation in sizes, thereby enabling driving force transmission torque required for depressing the rolls to be made larger.

Also, the rotative driving devices for depressing the rolling rolls may be provided separately to allow the depression amount of rolling rolls to be adjusted separately and freely.

Further, a preferred embodiment of roll fixing device of 3-roll rolling mill will be explained with reference to FIGS. 5 and 6.

Figure 5:
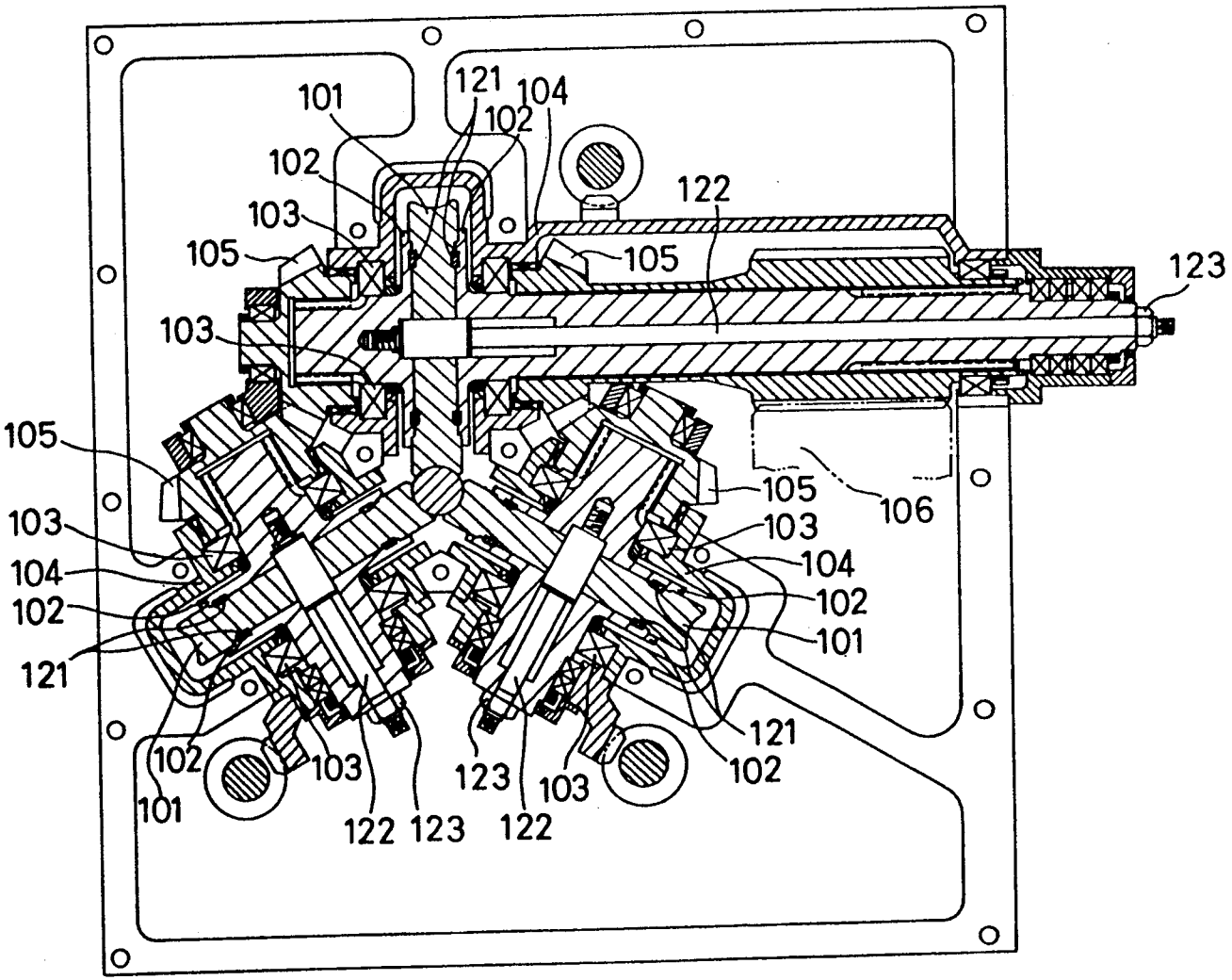
FIG. 5 is an entire sectional view of a principal portion in a preferred embodiment for a roll fixing device in 3-roll rolling mill.

In FIG. 5, 101 does, as in the FIG. 4 embodiment, show three rolling rolls arranged radially at an interval of 120° in the vertical plane, the rolls 101 being sandwiched by the respective pair of roll holders 102 which are supported through bearings 103 by tubular support frames 104 rotatably at an eccentric point.

The feature that the roll holders 102 are supported by the tubular support frames 104 is provided for that the support frames 104 are rotated to shift the roll holders 102 with respect to the central portion of rolled material so as to adjust the depression amount of rolling rolls 101.

It will be appreciated that the rolling rolls 101 are adapted to be driven for rotation by an input side gear 106 through a bevel gear 105 interlocked with the roll holder 102.

The rolling rolls 101 are sandwiched at both lateral sides by the pair of roll holders 102, and the rolls and holders are tightened at a serrated part 121.

Figure 6:
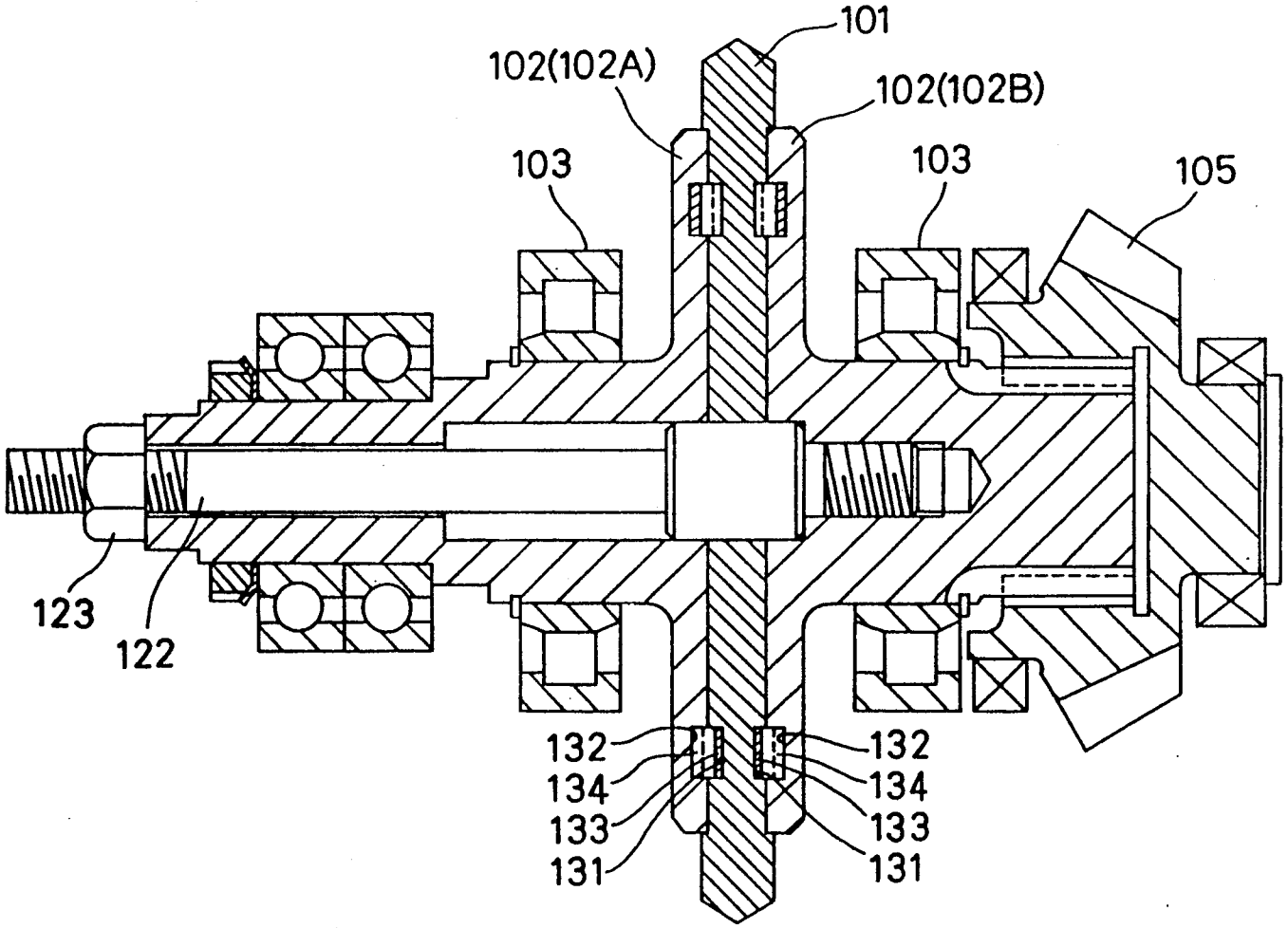
FIG. 6 is a sectional view of a principal portion of the roll fixing device.

As seen in FIG. 6, the pair of roll holders 102 are adapted to approach each other by a tightening member including a bolt 122 and a nut 123. The rolling roll 101 is provided at both sides with a first annular groove 131, and the corresponding roll holders 102 are provided at their surfaces with a second annular groove 132. A serration ring 133, 134 which is serrated at one side surface is fit into the annular grooves 131, 132. The serration rings 133, 134 are fit to the rolling roll 101 and roll holder 102 by use of a mounting pin (not shown) as that the serrated parts of the serration rings fit in the opposing annular grooves 131, 132 are engaged with each other.

In fixing the rolling roll 101 and roll holders 102, the nut 123 is screwed in the state that the rings 133, 134 are mounted in the annular grooves 131, 132, so as to cause one roll holder 102B to approach the other roll holder 102A to tighten the roll 101 by the holders 102A, 102B, thereby causing the serration rings 133, 134 to be brought into mesh with each other, and the roll 101 to be fixed.

The rolling roll 101 may be replaced by loosening the nut 123 to separate the holders 102A, 102B and draw the bolt 122.

Since the rolling roll 101 and roll holders 102 are coupled and fixed by use of the serration rings 133, 134, a driving force to be transmitted to the other rolls through the bevel gear 105 connected with the holders 102 can be made quite larger in comparison with the case that a driving force is transmitted through a frictional force obtained by a mere sandwiching of the rolling roll with a pair of roll holders.

In the above example, serration rings are used as the serrated part to couple and fix the roll and holders. Alternatively, the serrated part may be formed directly on the rolling roll and roll holders which are coupled and fixed to each other.

The abovesaid fixing device may be applicable to a common roll holder 102B to approach the other roll holder 102A to tighten the roll 101 by the holders 102A, 102B, thereby causing the serration rings 133, 134 to be brought into mesh with each other, and the roll 101 to be fixed.

The rolling roll 101 may be replaced by loosening the nut 123 to separate the holders 102A, 102B and draw the bolt 122.

Since the rolling roll 101 and roll holders 102 are coupled and fixed by use of the serration rings 133, 134, a driving force to be transmitted to the other rolls through the bevel gear 105 connected with the holders 102 can be made quite larger in comparison with the case that a driving force is transmitted through a frictional force obtained by a mere sandwiching of the rolling roll with a pair of roll holders.

In the above example, serration rings are used as the serrated part to couple and fix the roll and holders. Alternatively, the serrated part may be formed directly on the rolling roll and roll holders which are coupled and fixed to each other.

The abovesaid fixing device may be applicable to a common rolling mill other than the 3-roll rolling mill referred to above.

As seen from the above, according to the rolling fixing device of the present invention, fixing of rolling roll and roll holders is carried out through the serrated part, so that the pair of roll holders may be approached each other merely by tightening a tightening member to surely and simply fix the roll and holders.

Also, in replacement of the rolling rolls, the tightening member may be loosened to separate the roll holders for removing the rolls, thereby providing a quite simple and quick replacement work for the rolling rolls in comparison with the conventional case that a rolling roll is fixed to its driving shaft by use of a key or the driving shaft is given a polygonal sectional shape for fitting into the roll.

What we claimed is:

1. A sizing mill operated under a common driving system, comprising:

prime mover means;

an upstream rolling mill and a downstream rolling mill driven by said prime mover means;

a first power transmission device for transmitting power from said prime mover means to said downstream rolling mill;

a second power transmission device for transmitting power from said prime mover means to said downstream rolling mill, said second power transmission device allowing said downstream rolling mill to develop a higher feed speed than said first power transmission device;

a one-way clutch incorporated in said first power transmission device for disengaging a driven side from a driving side of said first power transmission device when power transmission from said prime mover means to said downstream rolling mill is effected through said second power transmission device; and switching means for engaging said downstream rolling mill with said first power transmission device when material lying in a space between said upstream and downstream rolling mills comes to undergo tensile force such that said tensile force divided by mean resistance to deformation of said material is in excess of 0.2 and engaging said downstream rolling mill with said second power transmission device when said material lying in said space comes to undergo compressive force such that said compressive force divided by mean resistance to deformation of said material is in excess of 0.1.

2. A sizing mill as set forth in claim 1, wherein:

said first power transmission device comprises a first gear located next to said prime mover means, a second gear for engaging and disengaging said first gear by means of said one-way clutch, and a power take-off gear in mesh engagement with said second gear;

said one-way clutch disengaging said second gear from said first gear when said second gear is revolved at a higher revolution speed than said first gear;

said second power transmission device comprises said first gear and a third gear in mesh engagement with said first gear;

said switching means comprises clutch means interposed between said third gear and said power take-off gear; and the number of revolutions attained by said third gear during the time said first gear makes one revolution is larger than the number of revolutions attained by said power take-off gear during the time said second gear makes one revolution.

* * * * *